US009127505B2

(12) United States Patent
Olberding et al.

(10) Patent No.: US 9,127,505 B2
(45) Date of Patent: Sep. 8, 2015

(54) PLATE FOR PROTECTING DOOR EDGE ADJACENT HARDWARE

(71) Applicant: Edward Wayne, Inc., Overland Park, KS (US)

(72) Inventors: Ronald E. Olberding, Kansas City, MO (US); David W. Allen, Overland Park, KS (US)

(73) Assignee: Edward Wayne, Inc., Overland Park, KS (US)

( * ) Notice: Subject to any disclaimer, the term of this patent is extended or adjusted under 35 U.S.C. 154(b) by 0 days.

(21) Appl. No.: 14/172,455

(22) Filed: Feb. 4, 2014

(65) Prior Publication Data

US 2015/0218878 A1 Aug. 6, 2015

(51) Int. Cl.

| | |
|---|---|
| ***E05F 7/00*** | (2006.01) |
| ***E06B 3/88*** | (2006.01) |
| ***E06B 3/36*** | (2006.01) |
| ***E05B 65/06*** | (2006.01) |
| ***E06B 7/16*** | (2006.01) |

(52) U.S. Cl.

CPC . *E06B 3/88* (2013.01); *E05B 65/06* (2013.01); *E06B 3/36* (2013.01); *E06B 7/16* (2013.01)

(58) Field of Classification Search

CPC ..... E06B 3/88; E06B 3/36; E06B 7/16; E05B 65/06

USPC ..... 49/460, 462; 292/340; 70/416, 417, 70/450, 452; 16/223

See application file for complete search history.

(56) References Cited

U.S. PATENT DOCUMENTS

| | | | | | |
|---|---|---|---|---|---|
| 375,038 | A | * | 12/1887 | Wright | 16/246 |
| 963,451 | A | | 7/1910 | Lowe | |
| 2,489,072 | A | * | 11/1949 | Ausubel | 16/402 |
| 3,279,840 | A | * | 10/1966 | Barone | 292/346 |
| 4,397,168 | A | * | 8/1983 | Rotondi et al. | 70/417 |
| 4,474,394 | A | * | 10/1984 | Crepinsek | 292/340 |
| 4,547,930 | A | * | 10/1985 | King et al. | 16/382 |
| 4,635,399 | A | * | 1/1987 | Gehrke et al. | 49/460 |
| 4,858,384 | A | * | 8/1989 | Blankenship | 49/460 |
| 5,024,475 | A | * | 6/1991 | Francis | 292/340 |
| 5,031,946 | A | * | 7/1991 | Yarrow | 292/337 |
| 5,070,650 | A | * | 12/1991 | Anderson | 49/460 |
| 5,171,050 | A | * | 12/1992 | Mascotte | 292/341.18 |
| D353,319 | S | * | 12/1994 | Eckert | D8/346 |
| 5,392,565 | A | * | 2/1995 | Rentschler | 49/504 |
| 5,474,347 | A | * | 12/1995 | Vigneault et al. | 292/340 |
| D372,191 | S | * | 7/1996 | Bennett | D8/403 |
| 5,566,509 | A | * | 10/1996 | Long | 49/462 |
| 5,566,995 | A | * | 10/1996 | Jagiela | 292/346 |
| 5,819,372 | A | * | 10/1998 | Magoon | 16/382 |
| 5,836,628 | A | * | 11/1998 | Beier | 292/346 |
| D417,516 | S | * | 12/1999 | White | D25/199 |
| 6,178,700 | B1 | * | 1/2001 | Mayer, Jr. | 49/504 |
| 6,185,881 | B1 | * | 2/2001 | Olberding et al. | 52/204.1 |
| D446,107 | S | * | 8/2001 | Carter | D8/346 |

(Continued)

*Primary Examiner* — Jerry Redman

(74) *Attorney, Agent, or Firm* — Hovey Williams LLP

(57) ABSTRACT

A door assembly for presenting a closeable doorway opening includes a door and a door reinforcement brace. The door is operable to be swingably mounted for swinging movement into and out of a closed position in which the door is located generally within the doorway opening. The door presents opposite interior and exterior surfaces and a perimetric edge surface. The brace is attached to the door to overlie at least portions of the interior and edge surfaces to reinforce the door, with no part of the door reinforcement brace extending exteriorly beyond the exterior surface of the door.

31 Claims, 8 Drawing Sheets

(56) References Cited

U.S. PATENT DOCUMENTS

| | | | | |
|---|---|---|---|---|
| 6,305,127 | B1 | 10/2001 | Olberding et al. | |
| 6,581,333 | B2 * | 6/2003 | Kimball | 49/504 |
| 6,679,004 | B1 | 1/2004 | Olberding et al. | |
| 6,901,706 | B2 | 6/2005 | Olberding et al. | |
| 7,134,246 | B1 | 11/2006 | Olberding et al. | |
| 7,360,809 | B1 * | 4/2008 | Poston | 292/340 |
| 7,467,818 | B2 | 12/2008 | Young | |
| 7,552,511 | B2 * | 6/2009 | Campbell et al. | 16/238 |
| 7,866,113 | B2 * | 1/2011 | Young | 52/656.4 |
| 7,921,603 | B2 * | 4/2011 | Darnell | 49/504 |
| 7,946,635 | B2 | 5/2011 | Canerdy, Jr. | |
| 8,006,527 | B2 * | 8/2011 | Nowakowski et al. | 70/417 |
| 8,510,995 | B2 * | 8/2013 | Fulton et al. | 49/460 |
| 8,793,936 | B2 * | 8/2014 | Fulton et al. | 49/460 |
| 2003/0159361 | A1 * | 8/2003 | Yeremian | 49/504 |
| 2008/0224486 | A1 * | 9/2008 | Anderson | 292/340 |
| 2010/0115862 | A1 | 5/2010 | Young | |
| 2010/0126088 | A1 | 5/2010 | Young | |
| 2010/0269431 | A1 | 10/2010 | Young | |
| 2010/0307078 | A1 | 12/2010 | Young | |
| 2012/0228887 | A1 * | 9/2012 | McMullen | 292/340 |

* cited by examiner

PLATE FOR PROTECTING DOOR EDGE ADJACENT HARDWARE

BACKGROUND

1. Field

The present invention relates generally to fenestration structures. More specifically, embodiments of the present invention concern a door assembly with a door reinforcing brace that reinforces the door adjacent to door hardware.

2. Discussion of Prior Art

Conventional door assemblies and other fenestration products installed on a building or other enclosure can be exposed to damaging forces. With the application of an excessive force (such as an impact force applied to the door in a building ingress direction), the door and/or framework of the building can experience damage that permits unauthorized entry.

Various fenestration products have been designed to resist such forces and associated structural damage (including damage that permits unauthorized building entry). For instance, turning to FIGS. 1-3, one conventional door assembly DA includes a door, a lock assembly LA mounted on the door, and a metal escutcheon plate E secured to the door. The plate E is U-shaped and wraps around an edge surface of the door to present opposite flanges F. The plate E is attached to the door with screws S that extend through the flanges F and through the area of the plate between the flanges F. The plate E also presents a bolt opening that slidably receives a bolt of the lock assembly LA.

Another conventional door assembly with reinforcement structure is disclosed in U.S. Pat. No. 6,679,004. The disclosed door assembly includes a door mounted on a door jamb with a reinforced hinge. The hinge includes plates that each include a reinforcement projection. In yet another prior art door assembly, disclosed in U.S. Pat. No. 6,305,127, a door strike plate includes a flat body and a transverse projection. The strike plate is secured to a jamb with fasteners that extend through the flat body and the projection.

However, the prior art fenestration products have various deficiencies. For example, the U-shaped plate E has been found to conduct past any thermal barrier provided by the door assembly. The plate E can also interfere with smooth swinging operation of the door and is known to be unsightly. The reinforced hinge disclosed by the '004 patent has been found to be ineffective at resisting damage when excessive force is applied to the adjacent door. The strike plate of the '127 patent is deficient as part of a reinforced door assembly because the strike plate does not reinforce the door itself and restrict damage to the door.

SUMMARY

The following brief summary is provided to indicate the nature of the subject matter disclosed herein. While certain aspects of the present invention are described below, the summary is not intended to limit the scope of the present invention.

Embodiments of the present invention provide a door assembly that does not suffer from the problems and limitations of the prior art fenestration products set forth above.

A first aspect of the present invention concerns a door assembly for presenting a closeable doorway opening between an interior and an exterior. The door assembly broadly includes a door and a door reinforcement brace. The door is operable to be swingably mounted for swinging movement into and out of a closed position in which the door is located generally within the doorway opening. The door presents opposite interior and exterior surfaces that face the interior and exterior, respectively, when the door is in the closed position. The door presents a perimetric edge surface that extends between the interior and exterior surfaces. The door reinforcement brace is attached to the door to overlie at least portions of the interior and edge surfaces to reinforce the door, with no part of the door reinforcement brace extending exteriorly beyond the exterior surface of the door.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein.

Figure 10:
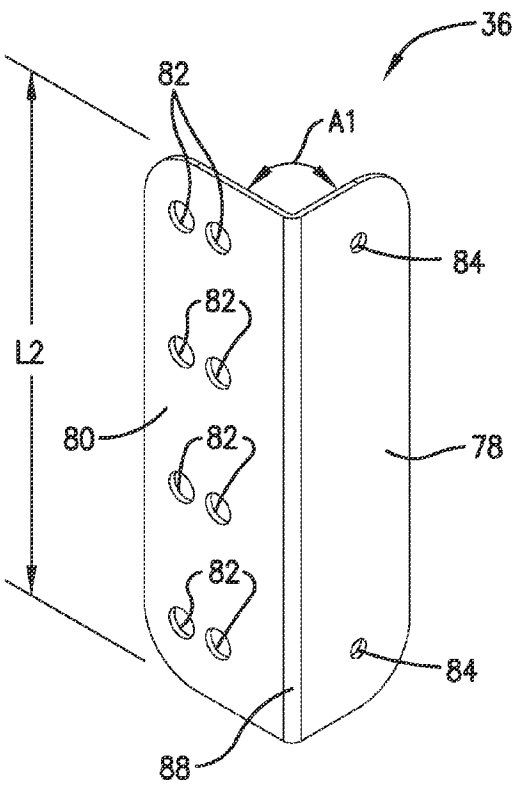
Figure 11:
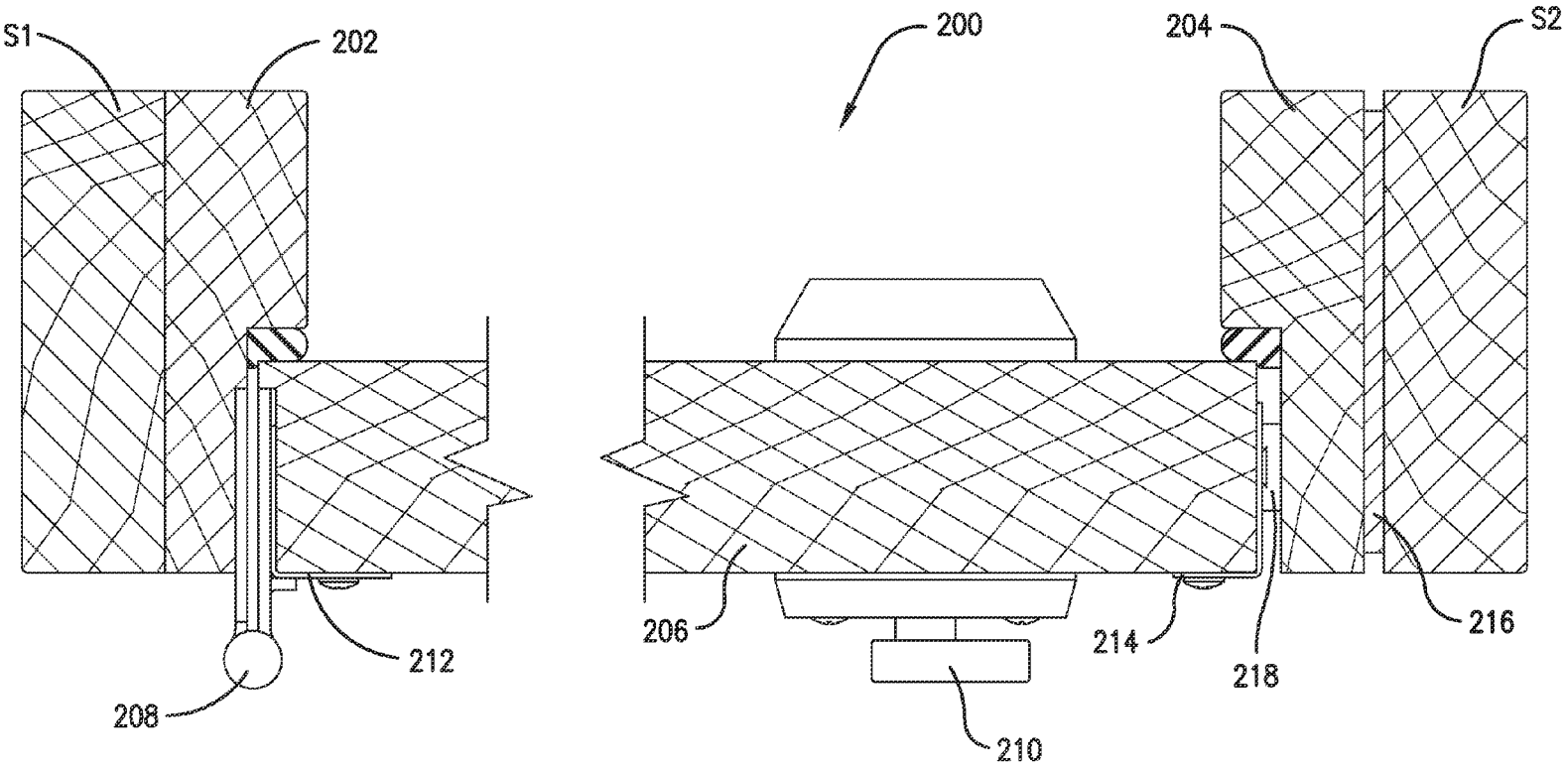

FIG. 10 is a perspective of the hinge-side reinforcement brace shown in FIGS. 4-6 and 8; and FIG. 11 is a cross section of a door assembly and building framework constructed in accordance with a second preferred embodiment of the present invention, showing a reinforcement plate secured between a door jamb and stud and positioned adjacent to a locking mechanism of the door assembly, with the plate presenting a bolt opening operable to receive a bolt of the locking mechanism.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
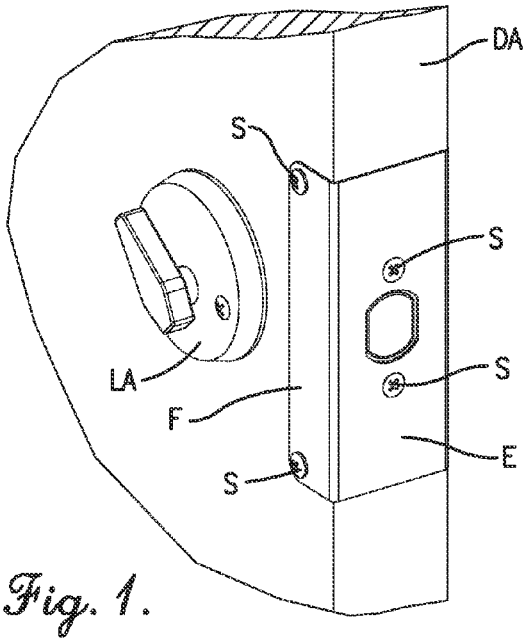
Fig. 1. PRIOR ART
FIG. 1 is a fragmentary perspective of a prior art door assembly including a door, a lock assembly, and a U-shaped escutcheon plate.
Figure 3:
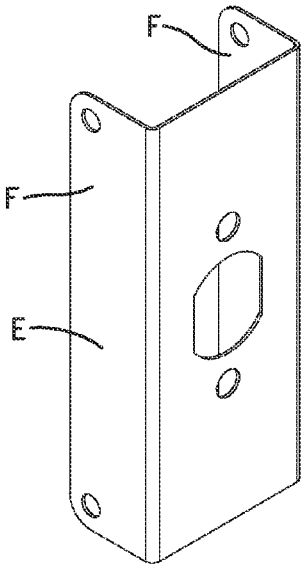
Fig. 3. PRIOR ART
FIG. 3 is a perspective view of the U-shaped escutcheon plate shown in FIGS. 1 and 2.
Figure 2:
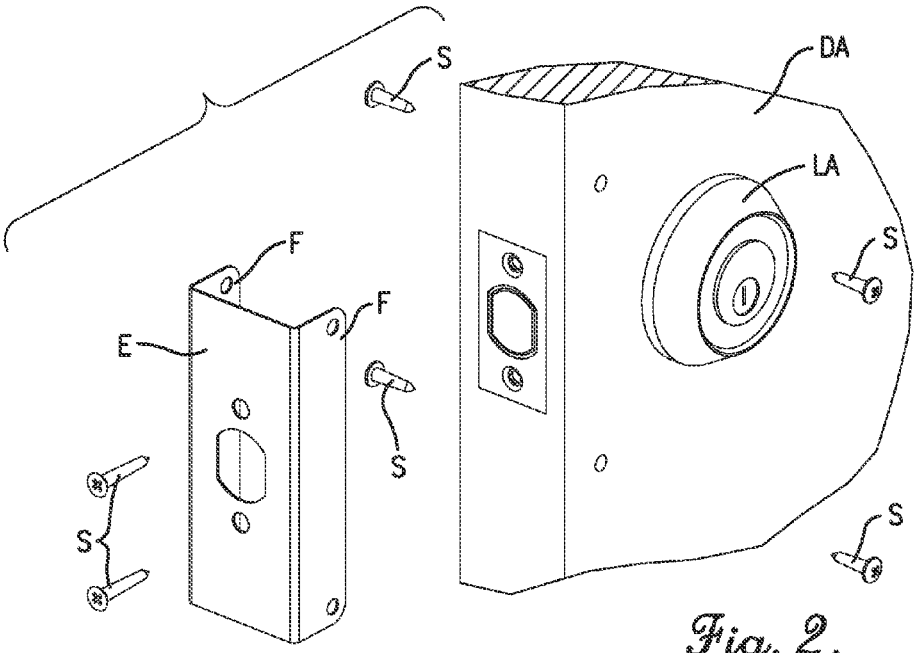
Fig. 2. PRIOR ART
FIG. 2 is a fragmentary perspective of the prior art door assembly shown in FIG. 1, showing the U-shaped escutcheon plate exploded from the door.
Figure 4:
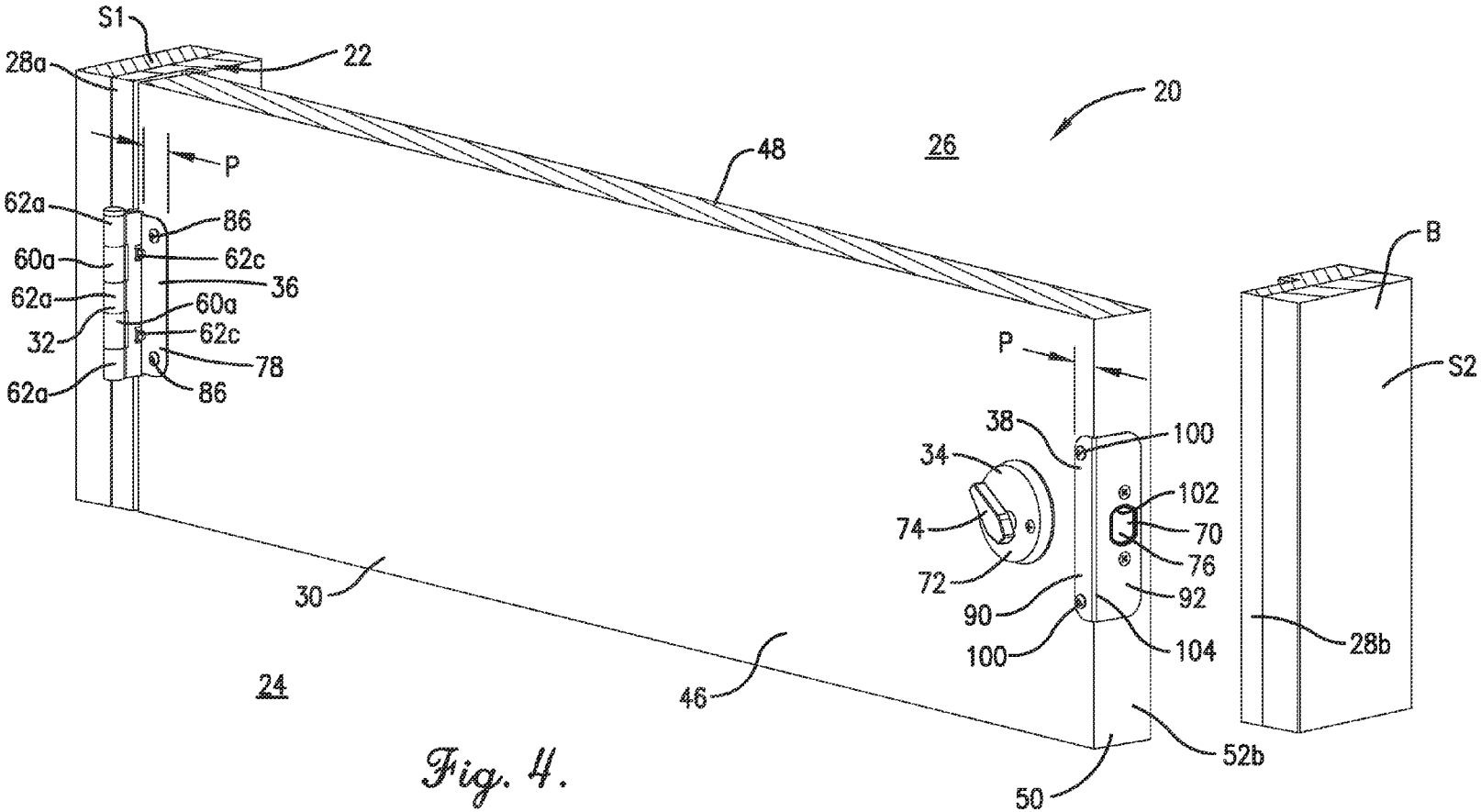
FIG. 4 is a fragmentary perspective of a door assembly constructed in accordance with a preferred embodiment of the present invention, with the door assembly operably mounted in a building framework and including jambs, a door, a hinge, a locking mechanism, a hinge-side reinforcement brace, and a lock-side reinforcement brace.
Figure 5:
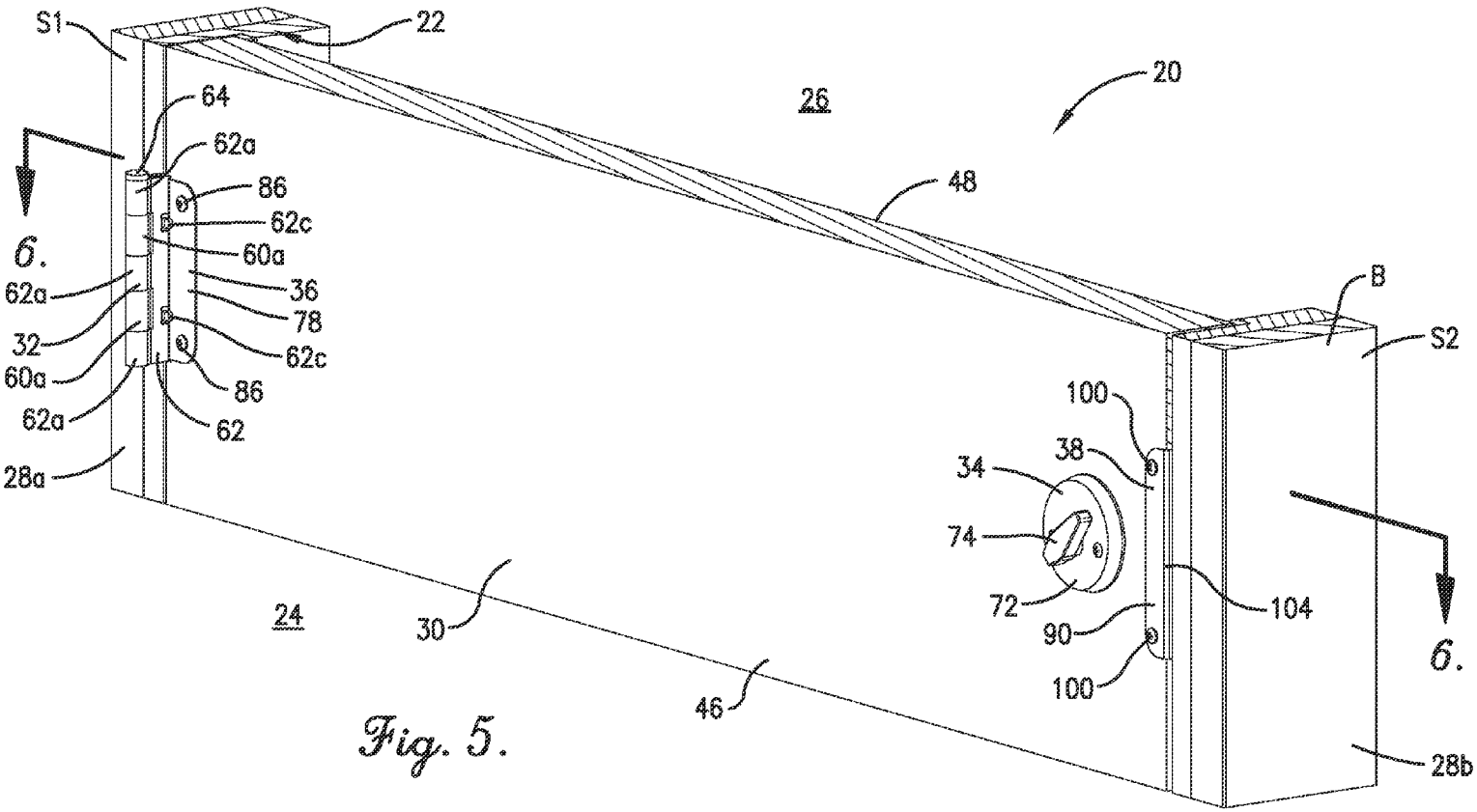
FIG. 5 is a fragmentary perspective of the door assembly and building framework similar to FIG. 4, but showing the door closed and the locking mechanism locked.

Turning initially to FIGS. 4 and 5, a door assembly 20 is constructed in accordance with a preferred embodiment of the present invention. The door assembly 20 provides a reinforced door construction that is mounted within a doorway opening 22 presented by a conventional building framework B. The illustrated door assembly 20 is configured to separate an interior 24 from an exterior 26.

It will be appreciated that elements of the inventive door assembly 20, while preferably used to permit building ingress and egress by a person, can be installed for doors in various other applications. For instance, features of the door assembly 20 could be used to reinforce and secure the door of a cabinet or storage enclosure. The door assembly 20 preferably includes door jambs 28*a,b*, a door 30, hinges 32, a locking mechanism 34, hinge-side reinforcement braces 36, and a lock-side reinforcement brace 38.

The framework B includes conventional framed stud walls with a plurality of studs. The studs preferably include a pair of wall studs S1,S2 and a header (not shown) that cooperatively form the doorway opening 22. The wall studs S1,S2 each preferably comprise a wood two-by-four stud construction, although it is within the scope of the present invention where the wall studs S1,S2 are alternatively configured. For instance, the wall studs S1,S2 could be alternatively sized. Also, the wall studs S1,S2 could comprise formed metal studs.

Figure 6:
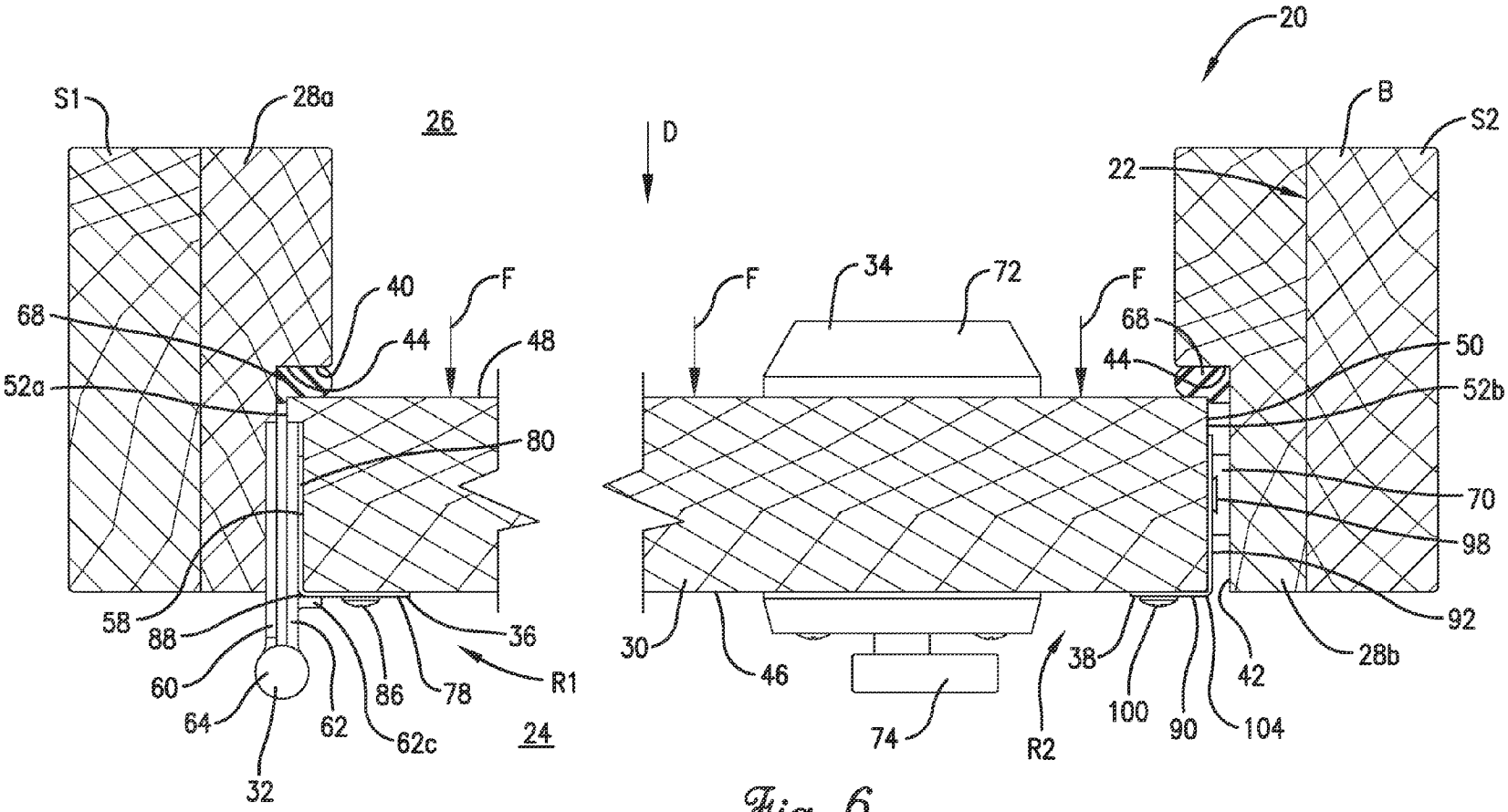
FIG. 6 is a cross section of the door assembly and building framework taken along line 6-6 in FIG. 5.

Turning to FIGS. 4-6, the door jambs 28*a,b* each comprise an elongated wood jamb that presents a stop shoulder 40 and a jamb surface 42 that cooperatively define an interior corner 44 of the jamb 28. In the usual manner, the jambs 28*a,b* are connected to one another adjacent upper ends thereof by a crossbeam (not shown). The door assembly 20 also includes a sill (not shown) that extends between lower ends of the door jambs 28*a,b*. As is customary, the jambs 28*a,b* are secured to the framework B with nails or other fasteners (not shown) so that the stop shoulders 40 are aligned with one another along an ingress direction D (see FIG. 6).

It is within the principles of the present invention where the door assembly 20 includes an alternative structure adjacent the door jambs 28*a,b*. For instance, the door assembly 20 could include one or two sidelight windows located adjacent to corresponding jambs 28*a,b*. Also, the door assembly 20 could include a transom window extending above the opening 22.

In the usual manner, the door 30 is operable to be swingably mounted for swinging movement into and out of a closed position (see FIGS. 5 and 6) in which the door 30 is located generally within the doorway opening 22. The door 30 preferably comprises a conventional wood door, although other door constructions are within the ambit of the present invention. For example the door 30 could alternatively be formed of metal (such as steel), a metal and wood combination, etc. The door 30 presents interior and exterior door surfaces 46,48. The door surfaces 46,48 are preferably flat and planar, but could be alternatively shaped. As is customary, the door 30 also presents a perimetric edge surface 50 that extends from the interior surface 46 to the exterior surface 48.

The perimetric edge surface 50 includes, in the usual manner, top and bottom edge sections (not shown). The perimetric edge surface further includes opposite upright edge sections 52*a,b* that extend between the top and bottom edge sections. Again, the upright edge sections 52*a,b* preferably extend from the interior door surface 46 to the exterior door surface 48. However, it is within the scope of the present invention where the upright edge sections 52*a,b* lie between but do not extend to the interior door surface 46 and/or the exterior door surface 48. The top and bottom edge sections and the upright edge section 52*b* are preferably flat and planar. The upright edge section 52*a* is also flat and planar except for mortise recesses, as will be discussed.

Figure 7:
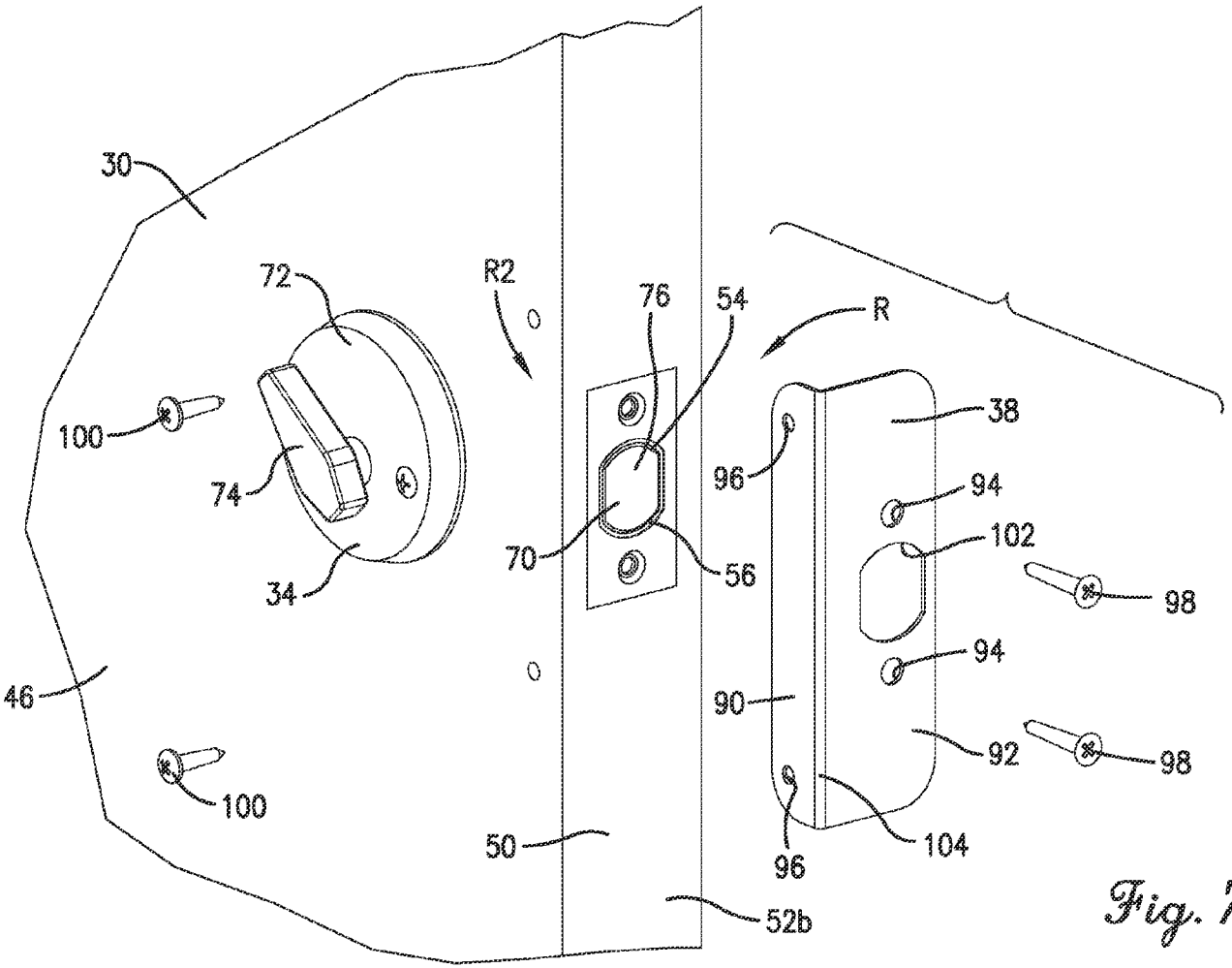
FIG. 7 is a fragmentary perspective of the door assembly shown in FIGS. 4-6, showing the lock-side reinforcement brace exploded from the door.

The door 30 preferably presents a door cavity 54 to receive the locking mechanism 34 (see FIG. 7). Preferably, the door cavity 54 includes a bolt opening 56 that intersects the upright edge section 52*a* and slidably receives a bolt of the locking mechanism 34 (see FIG. 7). However, the door cavity 54 could be constructed so that the bolt opening 56 intersects another one of the edge sections (e.g., so that the locking mechanism 34 can engage another structure of the framework B). The door 30 also presents multiple rectangular mortise recesses 58 that receive corresponding hinges 32.

Figure 8:
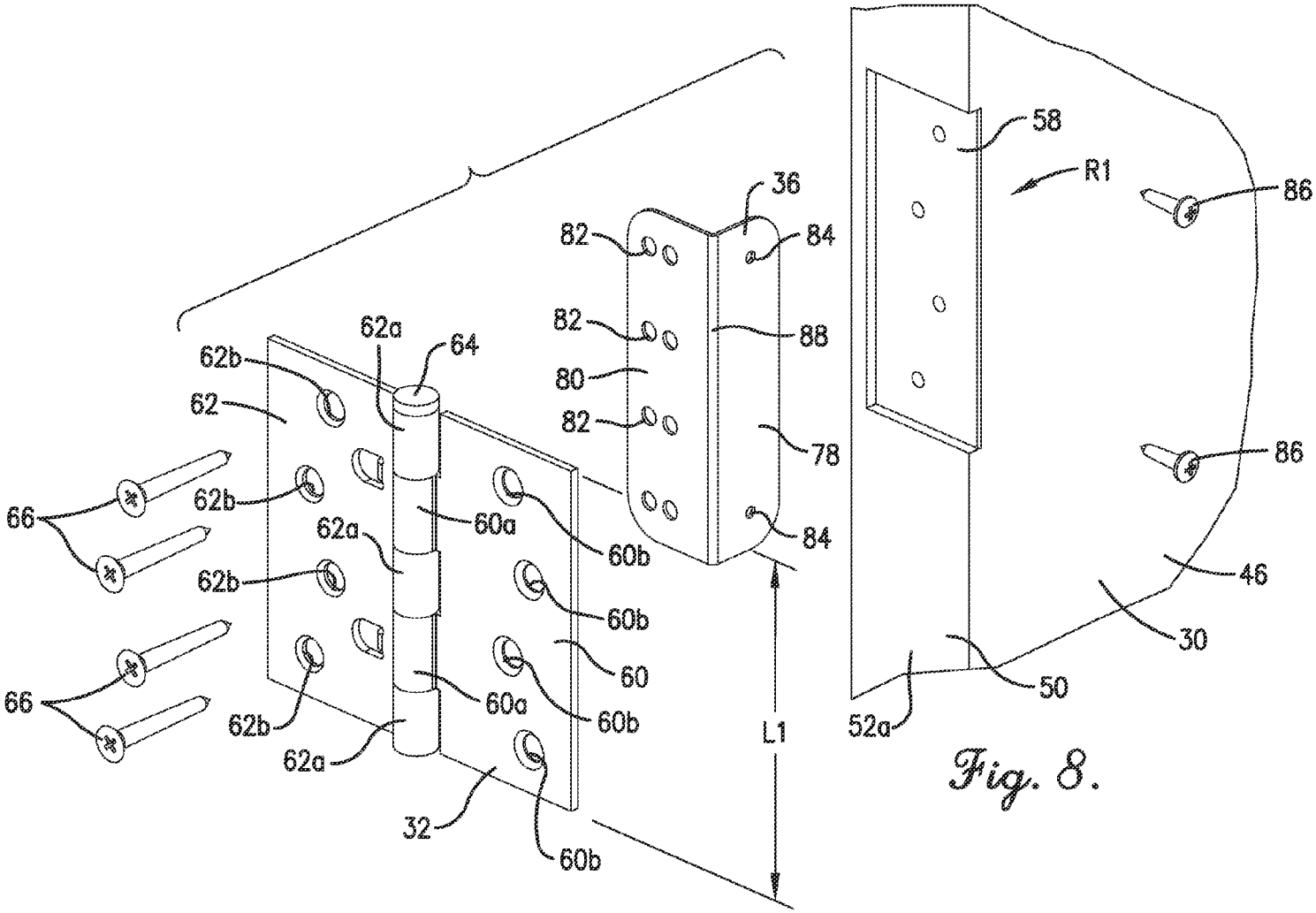
FIG. 8 is a fragmentary perspective of the door assembly shown in FIGS. 4-7, showing the hinge-side reinforcement brace and hinge exploded from the door.

Turning to FIG. 8, the door assembly 20 preferably includes three hinges 32 spaced along the height of the door 30 in the usual manner (although only one of the three hinges 32 is depicted herein). The hinges 32 are conventional and each include a pair of hinge plates 60,62 and a rod 64 that pivotally connects the hinge plates 60,62. In the usual manner, the hinge plate 60 includes a rectangular plate and tubular connectors 60*a* that are integrally formed, with the rectangular plate presenting holes 60*b*. Also, the hinge plate 62 includes a rectangular plate and tubular connectors 62*a* that are integrally formed, with the rectangular plate presenting holes 62*b*. Yet further, the hinge plate 62 includes tabs 62*c* that project laterally relative to the rectangular plate (see FIGS. 5 and 6). However, the principles of the present invention are equally applicable to hinges without the tab on the door hinge plate. The hinge plates 60,62 are pivotally secured to one another by aligning the connectors 60*a*,62*a* and extending the rod 64 through the connectors 60*a*,62*a*.

The hinge plates 60,62 present a length dimension L1 that is sized to fit within the mortise recess 58. The hinge plate 62 is positioned within a corresponding mortise recess 58 and is secured to the door 30 with threaded fasteners 66 that extend through the holes 62*b*. The other hinge plate 60 is secured to the door jamb 28*a* with threaded fasteners (not shown) that extend through holes 60*b*. As will be discussed, the hinge-side reinforcement braces 36 are located between the corresponding hinge plate and the door.

Turning to FIG. 6, the door assembly 20 also preferably includes weather strip 68 attached to the door jambs 28*a,b* and positioned within the corners 44. In the usual manner, the door 30 engages the weather strip 68 when the door 30 is closed to create a seal between the door 30 and the jambs 28*a,b*.

Turning again to FIGS. 4-6, the locking mechanism 34 is operable to selectively lock the door 30 in the closed position. The locking mechanism 34 includes a bolt 70, a cylinder assembly 72, and thumb turn 74. In the usual manner, the illustrated bolt 70 is slidable into and out of the bolt opening 56 between an unlocked position (see FIGS. 4 and 7), where an end 76 of the bolt 70 is substantially flush with the edge surface 52, and a locked position (see FIGS. 5 and 6), where the bolt 70 projects out of the bolt opening 56 and into an opening (not shown) in the door jamb 28*b* (when the door 30 is closed).

The illustrated locking mechanism 34 is mounted in the door 30 so that the bolt 70 slides through the upright edge section 52*a* to engage the jamb 28*b* when the bolt is locked. Further, the bolt 70 is preferably positioned at a location spaced vertically between the top and bottom sections of the edge surface 50. However, the locking mechanism 34 could be alternatively vertically positioned along the upright edge section 52*a*. Furthermore, the door 30 and locking mechanism 34 could be configured so that the bolt opening 56 slides through another one of the edge sections to engage another jamb or the top cross beam or sill (or an alternative structure that cooperates with the bolt 70 to selectively lock the door 30).

Turning to FIGS. 8 and 10, each hinge-side reinforcement brace 36 serves to reinforce the door 30 adjacent to the corresponding hinge plate 62. For instance, as will be described, the hinge-side reinforcement brace 36 serves to restrict relative movement between the hinge plate 62 and the door 30 when an excessive force (such as an excessive interiorly-directed impact force) is applied to the door 30. Such a force is often exerted against the exterior surface of the door 30 during a break-in attempt (e.g., by an intruder kicking the door 30).

The hinge-side reinforcement brace 36 preferably includes an interior brace section 78 and an edge brace section 80 (see FIG. 8). The brace sections 78,80 each preferably have the form of a rectangular flat plate. Also, the brace sections 78,80 are each preferably made of metal, such as carbon steel or stainless steel, and preferably present a maximum thickness of about one-eighth of an inch (⅛"). However, it is within the ambit of the present invention where the brace sections 78,80 are alternatively shaped and/or include an alternative material. The brace section 80 presents four (4) pairs of vertically spaced fastener openings 82 which receive respective fasteners 66. The brace section 78 presents a pair of vertically spaced fastener holes 84 that receive respective fasteners 86.

Preferably, the brace sections 78,80 are formed as part of a unitary plate structure and are joined along a bend 88 to form an L-shaped plate. The brace sections 78,80 are positioned to define an included angle A1 that is about ninety degrees)(90°) (see FIG. 10). Again, the principles of the present invention are applicable where the brace sections 78,80 are alternatively shaped and/or positioned relative to one another. For instance, the included angle A1 defined between the brace sections 78,80 could be greater than or less than ninety degrees) (90°).

While the brace sections 78,80 are preferably integrally formed with one another, it is within the scope of the present invention where the brace sections 78,80 are removably attached to one another along a connection. For instance, the brace sections 78,80 could have connector elements that cooperatively engage one another to interconnect the brace sections 78,80. Yet further, the hinge-side reinforcement brace 36 could have a connector that attaches to each of the brace sections 78,80 and thereby interconnects the brace sections 78,80.

When secured to the door 30, the edge brace section 80 preferably extends along and engages the upright edge section 52*a* (see FIG. 6). At the same time, the interior brace section 78 extends along and engages the interior surface 46. In the illustrated embodiment, the interior brace section 78 projects laterally inboard from the upright edge section 52*a* to define a projection dimension P, which is preferably about one inch (1") or less (see FIG. 4).

When the brace 36 is secured to the door 30, the space located exteriorly relative to the exterior surface 48 of the door 30 is preferably devoid of any part of the brace 36. That is, no part of the brace 36 extends exteriorly beyond the exterior surface 48 of the door 30. Preferably, the edge brace section 80 is spaced from the exterior door surface 48. However, the edge brace section 80 could extend up to the exterior door surface 48 from a location spaced interiorly of the exterior door surface 48.

While the brace 36 and hinge 32 are preferably positioned in engagement with the upright edge section 52*a*, it will be appreciated that the brace 36 could be installed along another section of the perimetric edge surface 50 (e.g., to provide door reinforcement adjacent the hinge). For instance, if the illustrated door were intended to be hinged along the top section of the edge surface 50, the brace 36 and hinge 32 would be correspondingly attached to the top section.

The hinge plate 62 and edge brace section 80 are secured to one another and to the door 30 by aligning the holes 62*b* of the hinge plate 62 with corresponding fastener openings 82 of the edge brace section 80. In this manner, threaded fasteners 66 can be inserted through holes 62*b* and openings 82 so that the fasteners 66 can be secured in the door 30. It is noted that the openings 82 are arranged in sets to accommodate hinges having different hole patterns.

The hinge plate 62 and the edge brace section 80 are preferably positioned within the corresponding mortise recess 58 and secured to the door 30 with fasteners 66. In the illustrated embodiment, the hinge plate 62 preferably overlies the edge brace section 80, with the edge brace section 80 positioned between the door 30 and the hinge plate 62. Thus, for each hinge 32 of the door assembly 20, a corresponding one of the braces 36 is secured between the hinge plate 62 and the door 30.

The edge brace section 80 presents a vertical length dimension L2 (see FIG. 10) that is slightly shorter than the length dimension L1 of the hinges 32 so that the edge brace section 80 fits within the mortise recess 58. It will be appreciated that the length dimensions L1,L2 could also be the same size while permitting the hinge plate 62 and the edge brace section 80 to be received within the recess 58. Preferably, the length dimension L2 has a maximum dimension of about twelve inches (12").

While the illustrated edge brace section 80 is positioned within the recess 58, it is within the ambit of the present invention where the door 30 does not present the mortise recess 58, such that the edge brace section 80 projects outwardly beyond the edge surface 50 of the door 30. However, the mortise recess 58 could be sized so that the edge brace section 80 is only partly recessed relative to the edge surface 50.

Again, the hinge-side reinforcement brace 36 serves to restrict relative movement between the hinge plate 62 and the door 30 when an excessive interiorly directed force is applied to the door. For instance, if a force F is applied to the door (see FIG. 6), the fasteners 66,86 and brace 36 cooperate to restrict the door 30 from being pried away from the hinge plate 62. At the same time, because no part of the brace 36 extends exteriorly beyond the exterior surface 48 of the door 30, the brace 36 does not interfere with the seal provided by the weather strip 68. Furthermore, because of the thin profile, the hinge-side reinforcement brace 36 negligibly impacts hinge location on the door 30.

With the hinge-side reinforcement brace 36 installed, a region R1 of the door 30 is reinforced (see FIG. 8) and the fasteners 66 are more securely held within the door 30. Without the brace 36, the fasteners 66 could be pushed through region R1 when a large force is exerted against the door 30 immediately adjacent the hinge 32.

Figure 9:
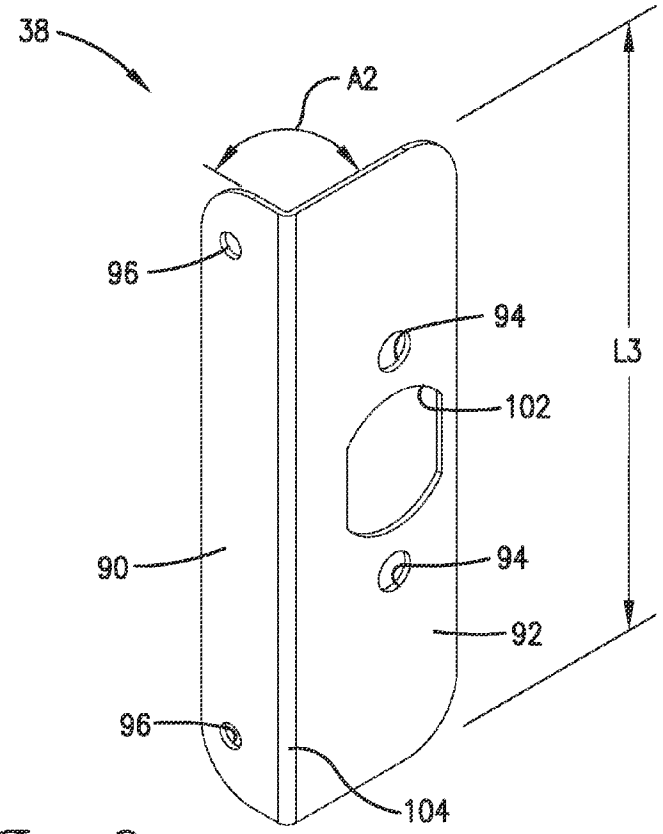
FIG. 9 is a perspective of the lock-side reinforcement brace shown in FIGS. 4-7.

Turning to FIGS. 7 and 9, each lock-side reinforcement brace 38 reinforces the door 30 adjacent to the locking mechanism 34. In particular, the lock-side reinforcement brace 38 serves to restrict a region R2 of the door 30 adjacent the bolt 70 (see FIGS. 6 and 7) from being displaced by the bolt 70 when an excessive interiorly directed force is applied to the door 30. That is, the lock-side reinforcement brace 38 restricts the region R2 from being separated from the rest of the door 30 by the bolt 70.

The lock-side reinforcement brace 38 preferably includes an interior brace section 90 and an edge brace section 92. The brace sections 90,92 each preferably have the form of a flat rectangular plate. Also, the brace sections 90,92 are each preferably made of metal, such as carbon steel or stainless steel, and preferably present a maximum thickness of about one-eighth of an inch (⅛"). However, it is within the ambit of the present invention where the brace sections 90,92 are alternatively shaped and/or include an alternative material. The edge brace section 92 preferably presents vertically spaced fastener openings 94. The interior brace section 90 preferably presents vertically spaced fastener openings 96. Preferably, the fastener openings 94 receive corresponding fasteners 98, and fastener openings 96 receive corresponding fasteners 100.

The edge brace section 92 also presents a bolt hole 102 that receives the bolt 70 when the brace 38 is secured to the door 30 (see FIG. 9). The bolt hole 102 of the brace 38 is preferably positioned so that the brace 38 extends higher and lower than the bolt 70. Also, the door assembly 20 is preferably configured so that fasteners 98,100 are spaced higher and lower than the bolt 70. However, the fasteners 98,100 could be alternatively arranged without departing from the scope of the present invention.

Preferably, the brace sections 90,92 are formed as part of a unitary plate structure and are joined along a bend 104 to form an L-shaped plate. The brace sections 90,92 are positioned to define an included angle A2 that is about ninety degrees) (90°). Again, the principles of the present invention are applicable where the brace sections 90,92 are alternatively shaped and/or positioned relative to one another. For instance, the included angle A2 defined between the brace sections 90,92 could be greater than or less than ninety degrees)(90°).

While the brace sections 90,92 are preferably integrally formed, it is within the scope of the present invention where the brace sections 90,92 are removably attached to one another along a connection. For instance, the brace sections 90,92 could have connector elements that cooperatively engage one another to interconnect the brace sections 90,92. Yet further, the hinge-side reinforcement brace 38 could have a connector that attaches to each of the brace sections 90,92 and thereby interconnects the brace sections 90,92.

When secured to the door 30, the edge brace section 92 preferably extends along and engages the upright edge section 52*b*. At the same time, the interior brace section 90 extends along and engages the interior surface 46. In the illustrated embodiment, the interior brace section 90 projects laterally inboard from the upright edge section 52*b* to define a projection dimension P, which is preferably about one inch (1") or less (see FIG. 4). The edge brace section 92 presents a vertical length dimension L3 (see FIG. 9). Preferably, the length dimension L3 has a maximum dimension of about twelve inches (12"). Those of ordinary skill in the art will appreciate that the dimension and shape of the brace 38 may be varied without departing from the ambit of the present invention. For example, if desired, the interior brace section 90 could alternatively be expanded to extend along the interior door surface 46 into a circumscribing relationship with the lock cylinder 72.

When the edge brace section 92 is secured to the door 30, the space located exteriorly relative to the exterior surface 48 of the door 30 is preferably devoid of any part of the brace 38. That is, no part of the brace 38 extends exteriorly beyond the exterior surface 48 of the door 30. Preferably, the edge brace section 92 is spaced from the exterior door surface 48. However, the edge brace section 92 could extend up to the exterior door surface 48 from a location spaced interiorly of the exterior door surface 48.

While the brace 38 is preferably positioned in engagement with the upright edge section 52*b*, it will be appreciated that the brace 38 could also be installed along another section of the perimetric edge surface 50 (e.g., to provide door reinforcement adjacent the locking mechanism 34). For instance, if the illustrated door were intended to be locked along the top section of the edge surface 50, the brace 38 would be correspondingly attached to the top section.

The edge brace section 92 is preferably secured to the door 30 with fasteners 98,100. The edge brace section 92 is mounted on the door 30 without being positioned within a mortised recess of the door 30. As a result, the edge brace section 92 projects outwardly from the edge surface 52 of the door 30. However, it is within the ambit of the present invention where the door 30 presents amortise recess that receives the edge brace section 92 such that the edge brace section 92 is partly recessed or fully recessed relative to the edge surface 52.

Again, the lock-side reinforcement brace 38 serves to restrict a region R2 of the door adjacent the bolt 70 (see FIGS. 6 and 7) from being displaced by the bolt 70 when an excessive interiorly directed force is applied to the door. For example, if the force F is applied to the door 30 (see FIG. 6), the fasteners 98,100 and brace 38 cooperate to restrict the region R2 of the door 30 from being deformed by the bolt 70.

The illustrated lock-side reinforcement brace 38 is preferably used to reinforce the region R2 (see FIG. 7) adjacent the locking mechanism 34. However, it is also within the scope of the present invention where the brace 38 is used to reinforce the region adjacent a door latch (not shown) of the door assembly 20. Further, the brace 38 could be configured to reinforce the door 30 adjacent both the locking mechanism 34 and the door latch.

The illustrated door assembly 20 preferably includes both types of braces 36,38 to reinforce the door 30. However, it will be appreciated that the door assembly 20 could employ only the hinge-side reinforcement braces 36 or only the lock-side reinforcement brace 38 without departing from the scope of the present invention.

In use, the brace 36 is secured to the door assembly 20 by locating the edge brace section 80 within the mortise recess 58 and in engagement with the upright edge section 52*a* while locating the interior brace section 78 in engagement with the interior surface 46. The hinge plate 62 and the edge brace section 80 are preferably secured to the door 30 with fasteners 66. The interior brace section 78 is secured to the door 30 with fasteners 86. The hinge plate 60 is secured to the jamb 28*a* with fasteners. For each hinge 32 of the door assembly 20, a corresponding one of the braces 36 is secured between the hinge plate 62 and the door 30.

The brace 38 is secured to the door assembly by locating the edge brace section 92 in engagement with the upright edge section 52*b* while locating the interior brace section 90 in engagement with the interior surface 46. The interior and edge brace sections 92 are secured to the door with corresponding fasteners 98,100. The brace 38 is positioned so that the bolt hole 102 receives the bolt 70 when the bolt 70 is locked.

Turning to FIG. 11, an alternative door assembly 200 is constructed in accordance with a second preferred embodiment of the present invention. For the sake of brevity, the following description will focus primarily on the differences of the alternative door assembly 200 compared to the door assembly 20. The door assembly 200 is mounted between studs S1,S2 and includes jambs 202,204, a door 206, hinge 208, locking mechanism 210, reinforcement braces 212,214, and a door assembly reinforcement plate 216. The reinforcement plate 216 preferably comprises a metal plate that presents a bolt opening (not shown). The plate 216 is secured between the jamb 204 and the stud S2. With the plate 216 secured, the bolt opening is sized and positioned to receive a bolt 218 of the locking mechanism 210 when the bolt 218 is locked. Additional preferred features of such a reinforced door assembly are disclosed in U.S. Pat. No. 7,134,246, issued Nov. 14, 2006, entitled METHOD AND APPARATUS FOR REINFORCING A DOOR ASSEMBLY, which is hereby incorporated in its entirety by reference herein. If desired, as disclosed in the '246 patent, a reinforcement plate may also be provided on the hinge side of the door assembly. Preferred features of an alternative reinforced door assembly are disclosed in U.S. Pat. No. 6,305,127, issued Oct. 23, 2001, entitled DOOR REINFORCEMENT ASSEMBLY, which is hereby incorporated in its entirety by reference herein.

Although the above description presents features of preferred embodiments of the present invention, other preferred embodiments may also be created in keeping with the principles of the invention. Such other preferred embodiments may, for instance, be provided with features drawn from one or more of the embodiments described above. Yet further, such other preferred embodiments may include features from multiple embodiments described above, particularly where such features are compatible for use together despite having been presented independently as part of separate embodiments in the above description.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A door assembly for presenting a closeable doorway opening between an interior and an exterior, said door assembly comprising:

a door operable to be swingably mounted for swinging movement into and out of a closed position in which the door is located generally within the doorway opening, said door presenting opposite interior and exterior surfaces that face the interior and exterior, respectively, when the door is in the closed position, said interior surface presenting an outermost planar portion, said door presenting a perimetric edge surface that extends between the interior and exterior surfaces;

a doorway stop shoulder being positioned exteriorly of the door and facing the exterior surface to restrict the door from swinging exteriorly when the door is in the closed position; and a door reinforcement brace being attached to the door to overlie and engage at least part of the edge surface and at least part of the outermost portion of the interior surface to reinforce the door, with no part of the door reinforcement brace extending exteriorly beyond the exterior surface of the door, said brace presenting an exteriormost margin spaced from the exterior surface of the door, such that an exposed section of the edge surface is defined between the exterior surface and the exteriormost margin.

2. The door assembly as claimed in claim 1, said door reinforcement brace being spaced from the exterior surface.

3. The door assembly as claimed in claim 2, said edge surface presenting top, bottom, and spaced apart upright sections, said door reinforcement brace extending along only one of the sections of the edge surface.

4. The door assembly as claimed in claim 3; and a pair of spaced apart jambs that generally define the doorway opening therebetween, said door being swingably mounted to one of the jambs.

5. The door assembly as claimed in claim 4, at least one of said jambs being provided with a weather strip, said one of the sections of the edge surface being one of the upright sections, said one of the upright sections being associated with and immediately adjacent to the at least one of the jambs when the door is in the closed position, said door reinforcement brace being spaced from the weather strip.

6. The door assembly as claimed in claim 4, at least one of said jambs presenting the stop shoulder.

7. The door assembly as claimed in claim 5, at least one of said jambs presenting the stop shoulder, with the weather strip located against the stop shoulder.

8. The door assembly as claimed in claim 4, said one of the sections of the edge surface being one of the upright sections, said door reinforcement brace including an interior part and an edge part, said interior part being smaller than the interior surface to overlie only a portion thereof, said edge part being smaller than said one of the upright sections to overlie only a portion thereof.

9. The door assembly as claimed in claim 1, said door reinforcement brace comprising a generally L-shaped plate that has an interior part overlying a portion of the interior surface and an edge part overlying a portion of the edge surface.

10. The door assembly as claimed in claim 9, said plate presenting a plurality of fastener-receiving openings; and a plurality of fasteners, each being received in a respective one of the openings and coupled to the door to secure the plate to the door.

11. The door assembly as claimed in claim 10, at least one of said fastener-receiving openings being defined in each part of the plate.

12. The door assembly as claimed in claim 9, said plate presenting a maximum vertical dimension of about twelve inches.

13. The door assembly as claimed in claim 12, said interior part of the plate projecting laterally from the edge surface about one inch or less.

14. The door assembly as claimed in claim 9, said door reinforcement brace being spaced from the exterior surface.

15. The door assembly as claimed in claim 1; and a lock mechanism operable to selectively lock the door in the closed position, said lock mechanism including a lock bolt shiftably mounted on the door, said door reinforcement brace including a lock-receiving opening through which the lock bolt shiftably passes.

16. The door assembly as claimed in claim 15, a pair of spaced apart jambs that generally define the doorway opening therebetween, said door being swingably mounted to one of the jambs, said lock mechanism being associated with the other of the jambs when the door is locked in the closed position.

17. The door assembly as claimed in claim 16, said edge surface presenting top, bottom, and spaced apart upright sections, said lock bolt projecting beyond one of the upright sections when the door is locked in the closed position, said one of the upright sections being associated with and immediately adjacent to said other of the jambs when the door is in the closed position, said door reinforcement brace including an interior part that overlies a portion of the interior surface and an edge part that overlies a portion of said one of the upright sections.

18. The door assembly as claimed in claim 17, said lock bolt being operably positioned at a location spaced vertically between the top and bottom sections of the edge surface, each of said parts of the door reinforcement brace extending lower and higher than the location.

19. The door assembly as claimed in claim 18, said door reinforcement brace presenting a plurality of fastener-receiving openings; and a plurality of fasteners, each being received in a respective one of the openings and coupled to the door to secure the door reinforcement brace to the door, at least one of said fastener-receiving openings being defined in each part of the door reinforcement brace.

20. The door assembly as claimed in claim 19, said other of the jambs being provided with a weather strip, said door reinforcement brace being spaced from the weather strip.

21. The door assembly as claimed in claim 16;

a hinge swingably supporting the door on said one of the jambs, said hinge including a pair of swingably interconnected hinge plates, with one of the hinge plates being fixed to said one of the jambs and the other of the hinge plates being fixed to the door; and a second door reinforcement brace attached to the door to overlie at least second portions of the interior and edge surfaces to reinforce the door, with no part of the second door reinforcement brace extending exteriorly beyond the exterior surface of the door, said second door reinforcement brace and said other of the hinge plates presenting a plurality of aligned fastener-receiving openings; and a plurality of fasteners, each being received in corresponding aligned ones of the fastener-receiving openings and coupled to the door to secure the second door reinforcement brace and said other of the hinge plates to the door.

22. The door assembly as claimed in claim 1, a pair of spaced apart jambs that generally define the doorway opening therebetween; and a hinge swingably supporting the door on one of the jambs, said hinge including a pair of swingably interconnected hinge plates, with one of the hinge plates being fixed to said one of the jambs and the other of the hinge plates being fixed to the door, said door reinforcement brace and said other of the hinge plates presenting a plurality of aligned fastener-receiving openings; and a plurality of fasteners, each being received in corresponding aligned ones of the fastener-receiving openings and coupled to the door to secure the door reinforcement brace and said other of the hinge plates to the door.

23. The door assembly as claimed in claim 22, said edge surface presenting top, bottom, and spaced apart upright sections, with one of the upright sections being associated with and immediately adjacent to said one of the jambs, said door reinforcement brace including an interior part that overlies a portion of the interior surface and an edge part that overlies a portion of said one of the upright sections.

24. The door assembly as claimed in claim 23, said fasteners being positioned at a location spaced vertically between the top and bottom sections of the edge surface, each of said parts of the door reinforcement brace extending lower and higher than the location.

25. The door assembly as claimed in claim 24, said fastener-receiving openings being located on only the edge part of the door reinforcement brace, said interior part of the door reinforcement brace presenting at least one fastener-receiving hole; and at least one fastener being received in the at least one hole and coupled to the door to secure the interior part of the door reinforcement brace to the interior surface of the door.

26. The door assembly as claimed in claim 25, said one of the jambs being provided with a weather strip, said door reinforcement brace being spaced from the weather strip.

27. The door assembly as claimed in claim 1, said interior surface and said edge surface each being generally flat and planar, with the door reinforcement brace contacting the interior and edge surfaces without requiring either of the surfaces to be mortised.

28. The door assembly as claimed in claim 27, said door reinforcement brace presenting a maximum thickness of about one-eighth inch.

29. The door assembly as claimed in claim 1, said door reinforcement brace including an interior part that overlies a corresponding portion of the interior surface, said interior part of the door reinforcement brace projecting from the edge surface to define a projection dimension, with the dimension being about one inch or less.

30. The door assembly as claimed in claim 1, said interior surface being entirely planar within the edge surface, such that the outermost portion is defined by the entirety of the interior surface.

31. The door assembly as claimed in claim 1; and a lock mechanism operable to selectively lock the door in the closed position, said lock mechanism including a lock bolt shiftably mounted on the door, said lock mechanism having a portion thereof positioned along the interior surface of the door, with the portion including an operator for shifting the lock bolt, said door reinforcement brace being spaced from said portion of the lock mechanism.

* * * * *